US007261639B2

(12) United States Patent
Smith et al.

(10) Patent No.: US 7,261,639 B2
(45) Date of Patent: Aug. 28, 2007

(54) GOLF CLUB RING

(76) Inventors: Bret John Smith, 3425 Chevy Chase Cir., Crown Point, IN (US) 46307; Robert Bruce Smith, 3921 Bonnie Dr., Crown Point, IN (US) 46307

( * ) Notice: Subject to any disclaimer, the term of this patent is extended or adjusted under 35 U.S.C. 154(b) by 0 days.

(21) Appl. No.: 10/709,646

(22) Filed: May 19, 2004

(65) Prior Publication Data

US 2004/0204259 A1 Oct. 14, 2004

Related U.S. Application Data

(63) Continuation-in-part of application No. 10/371,649, filed on Feb. 24, 2003, now abandoned.

(51) Int. Cl.
*A63B 53/14* (2006.01)

(52) U.S. Cl. ..... 473/206; 473/409

(58) Field of Classification Search ..... 473/201, 473/300, 302, 303, 219, 551, 409, 206
See application file for complete search history.

(56) References Cited

U.S. PATENT DOCUMENTS

| | | | | | |
|---|---|---|---|---|---|
| 1,213,014 | A * | 1/1917 | Rees | 473/203 |
| 1,974,875 | A * | 9/1934 | Reid | 473/201 |
| 2,091,458 | A * | 8/1937 | Sleight | 16/421 |
| 2,149,911 | A * | 3/1939 | East | 473/201 |
| 2,608,409 | A * | 8/1952 | Pinkerton | 473/256 |
| 3,252,706 | A * | 5/1966 | Rasasco, Sr. | 473/201 |
| 3,295,850 | A * | 1/1967 | Garrity | 473/201 |
| 3,647,220 | A * | 3/1972 | Burkart et al. | 473/238 |
| 3,716,239 | A * | 2/1973 | Goudreau | 473/256 |
| 3,837,647 | A * | 9/1974 | Jacques | 473/300 |
| 3,969,080 | A * | 7/1976 | Conlon | 422/102 |
| 4,588,191 | A * | 5/1986 | Stewart | 473/256 |
| D290,150 | S * | 6/1987 | Stewart | D21/759 |
| 5,000,331 | A * | 3/1991 | Conlon et al. | 215/386 |
| 5,377,984 | A * | 1/1995 | Ciccia | 473/206 |
| 5,423,536 | A * | 6/1995 | Brown | 473/300 |
| 5,511,790 | A * | 4/1996 | Duran | 473/201 |
| 5,690,566 | A * | 11/1997 | Bracho | 473/549 |
| 5,704,845 | A * | 1/1998 | Boyte | 473/205 |
| 5,906,548 | A * | 5/1999 | Hadge | 473/206 |
| 5,954,591 | A * | 9/1999 | Liberatore | 473/206 |
| 6,036,607 | A * | 3/2000 | Finegan | 473/206 |
| 6,113,501 | A * | 9/2000 | Richards | 473/46 |
| 6,152,831 | A * | 11/2000 | Arcenas | 473/206 |
| 6,482,113 | B1 * | 11/2002 | Finn | 473/551 |
| 6,652,398 | B2 * | 11/2003 | Falone et al. | 473/568 |

* cited by examiner

*Primary Examiner*—Raleigh W. Chiu
(74) *Attorney, Agent, or Firm*—Gary M. Hartman; Domenica N. S. Hartman; Hartman & Hartman, P.C.

(57) ABSTRACT

A method and device for preventing a golfer's hands from slipping off a golf club grip. The device has a body with an opening that defines an inner perimeter of the body, an outer perimeter spaced radially outward from and surrounding the inner perimeter, and a slot in the body that extends between the inner and outer perimeters thereof. The slot has a width greater than the diameter of the golf club shaft to permit installation of the body on the golf club. The opening in the body has a minimum dimension larger than the diameter of a second grip portion of the grip but smaller than the diameter of a first grip portion of the grip, so that the body can be prevented from being removed from the club over the first grip portion. In this manner, the device is secured on the grip by an interference fit.

18 Claims, 2 Drawing Sheets

GOLF CLUB RING

CROSS REFERENCE TO RELATED APPLICATIONS

This is a continuation-in-part patent application of co-pending U.S. patent application Ser. No. 10/371,649, filed Feb. 24, 2003 now abandoned.

BACKGROUND OF INVENTION

1. Field of the Invention

The present invention generally relates to the game of golf. More particularly, this invention relates to a device that can be placed on the grip of a golf club to improve the user's grip during wet weather conditions.

2. Description of the Related Art

It is well known in the golfing industry that a player's hand grip on the golf club shaft grip must be light rather than strong to allow the wrists of the player to rotate freely through the swing for squaring the club face to the ball at the point of impact, and to maximize the club head speed which controls the distance and direction of the ball. However, if a player strengthens his or her hand grip during wet weather conditions to prevent slippage of the club, the result will impede the wrist rotation and therefore prevent the squaring of the club face at impact, resulting in misdirection of the golf ball as well as decreasing the distance the ball travels.

In view of the above, there is a need for a device capable of reducing the risk of a player's hands slipping off a golf club grip while executing a golf swing in wet weather conditions.

SUMMARY OF INVENTION

The present invention provides a method and device for reducing the risk of a player's hands slipping off a wet golf club grip while executing a golf swing. The device is adapted to be installed on a golf club shaft and secured to the grip without requiring any modification of the club. The device is also configured to be removed from the golf club when its use is not required.

More particularly, the device of this invention is mountable on a golf club having a shaft with oppositely-disposed first and second ends, a grip at the first end of the shaft, and a head at the second end of the shaft. The grip has a first grip portion and a second grip portion located closer to the second end of the shaft than the first grip portion, and the grip is tapered so that the second grip portion has a smaller diameter than the first grip portion. The device comprises a body having an opening that defines an inner perimeter of the body, an outer perimeter spaced radially outward from and surrounding the inner perimeter, and a slot in the body that extends between the inner and outer perimeters thereof. The slot has a width greater than the diameter of the golf club shaft to permit installation of the body on the golf club. The opening in the body has a minimum dimension larger than the diameter of the second grip portion of the grip but smaller than the diameter of the first grip portion of the grip, so that the body is prevented from being removed from the club over the first grip portion. In this manner, the device is secured on the grip by an interference fit.

In view of the above, the method of this invention involves installing the device on the club by passing the shaft of the club through the slot, and then securing the device on the club by moving the device along the shaft and over the second grip portion toward the first grip portion until an interference fit is achieved between the inner perimeter of the body and the first grip portion. The device can be subsequently removed by simply forcing the device away from the first grip portion and onto the shaft, at which point the opening in the body is sufficiently large to allow the device to be removed from the club.

In view of the above, the device is capable of providing a barrier that prevents a golfer's hands from slipping off the end of the grip while executing a golf swing, such as during wet weather conditions. According to a preferred aspect of the invention, the device is also configured to resist torsional slip of a golfer's hands on the grip when swinging the club.

Other objects and advantages of this invention will be better appreciated from the following detailed description.

DETAILED DESCRIPTION

Figure 1:
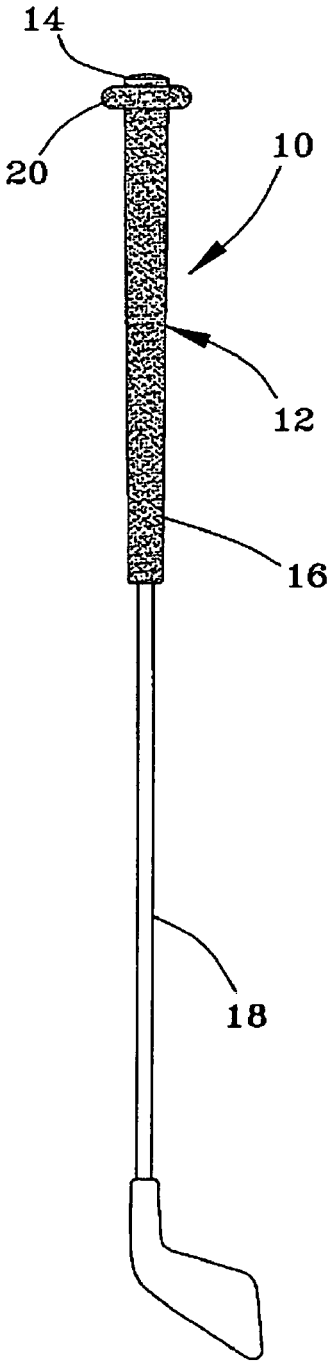
FIG. 1 is a side view of a golf club with a ring positioned on the grip of the club shaft in accordance with a preferred embodiment of this invention.
Figure 2:
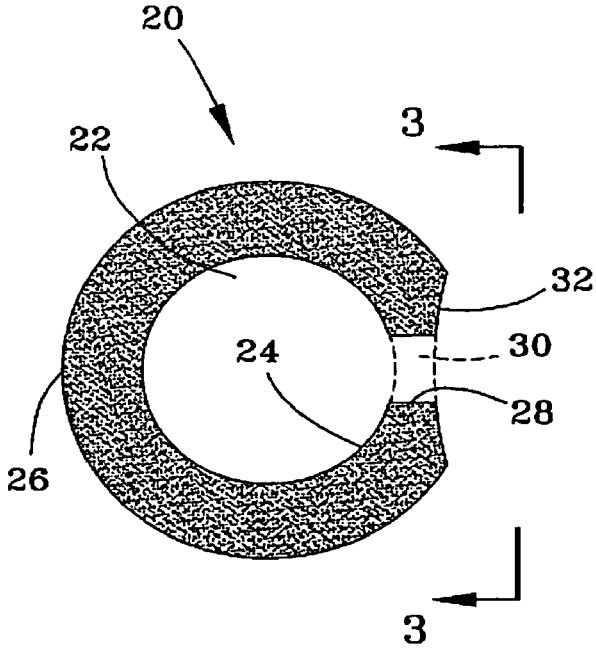
FIG. 2 is a plan view of the ring of FIG. 1.
Figure 3:
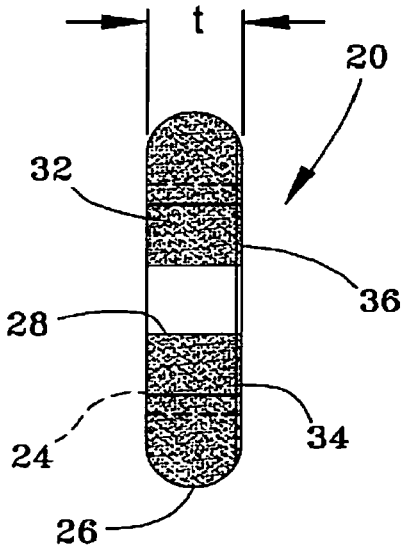
FIG. 3 is a side view of the ring of FIG. 2.
Figure 4:
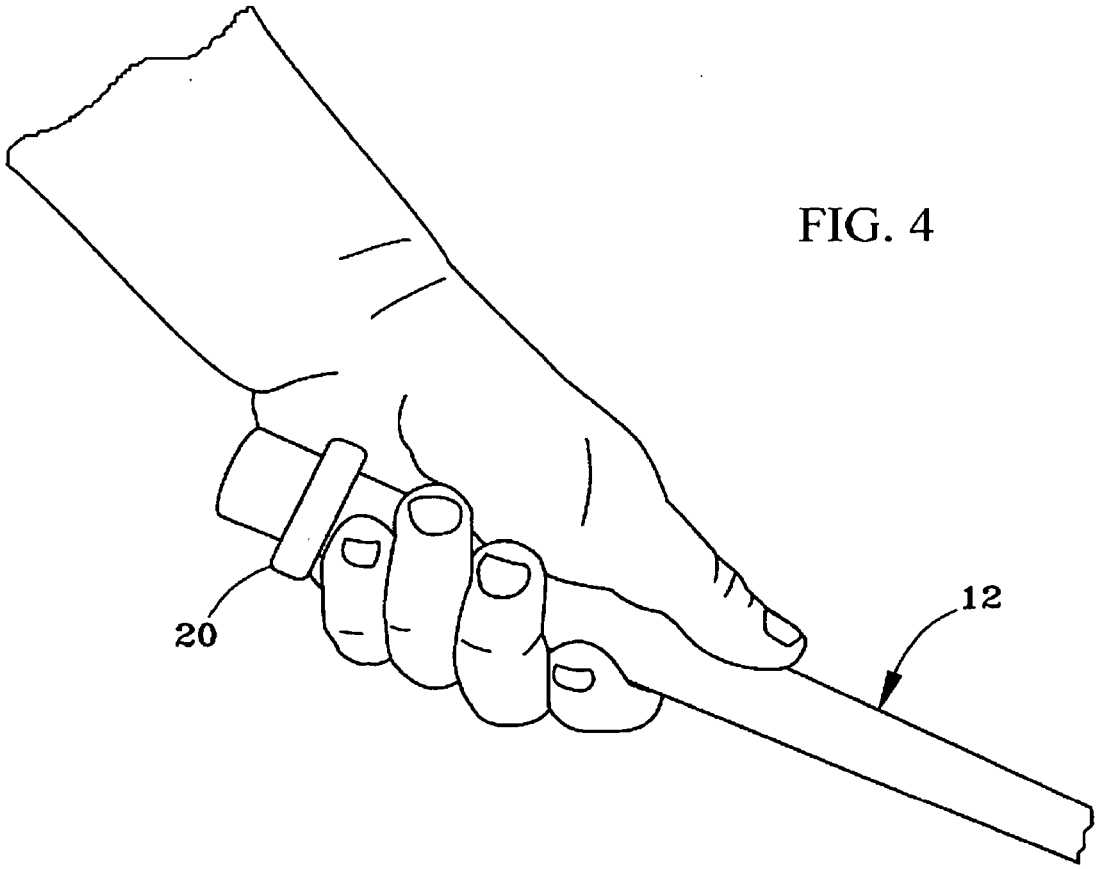
FIGS. 4 and 5 are two views showing a hand grasping the grip of the golf club of FIG. 1.
Figure 5:
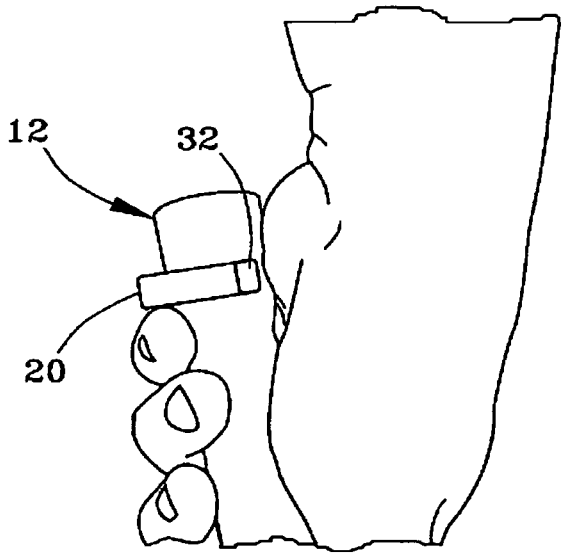

FIGS. 1 through 3 illustrate a golf club ring 20 that can be placed on a golf club 10 and positioned near the top of the hand grip 12 just below the upper end 14 of the grip 12, so that the ring 20 is secured to the grip 12 by an interference fit. In other words, the ring 20 has a central opening 22 that defines an inner perimeter 24 of the ring 20, and the inner perimeter 24 defines a diameter (or otherwise has a minimum dimension) that is larger than the outer diameter at the lower end 16 of the grip 12, but smaller than the outer diameter at the upper end 14 of the grip 12, so that the ring 20 can be positioned on the grip 12 by sliding the ring 20 upward from the lower end 16 of the grip 12 toward the upper end 14 of the grip 12, and the ring 20 is prevented from sliding off the upper end 14 of the grip 12. As such, when the grip 12 of the club 10 is properly gripped by a golfer, the ring 20 acts as a physical barrier that reduces the risk of the golfer's hands slipping off the end 14 of the grip 12.

In order to place the ring 20 on the club 10, the ring 20 is formed to have a slot 28 with a width sufficient to allow the shaft 18 of the club 10 to pass therethrough. The slot 28 is preferably closable with a suitable closure 30, represented in phantom in FIG. 2. The closure 30 can be held in a closed position by a variety of fastener devices, such as a hinge, slide, spring, etc. Alternatively, the closure 30 can be omitted so that slot 28 remains open, resulting in the ring 20 having a C-shaped configuration. The ring 20 is shown as having a particular shape in the Figures, though other shapes are possible. As such, the term "ring" is defined herein as a body shaped to have an inner perimeter, and does not limit the ring 20 to have a rounded cross-sectional shape.

The ring 20 can be formed of a variety of materials. However, the material for the ring 20 is preferably sufficiently rigid to prevent the inside diameter of the ring 20 from expanding large enough to slip off the upper end 14 of the grip 12. For example, the ring 20 is preferably not so pliable as to allow the slot 28 to be expanded to fit directly onto the grip 12 near its upper end 14, instead of the ring 20 being forced up into an interference fit with the upper end 14 of the grip 12. Alternatively, it is foreseeable that the ring 20 could be formed from a pliable material and with its inner diameter sufficiently sized or expandable for installation of the ring 20 over the upper end 14 of the grip 12, and thereafter the inner diameter is decreased or prevented from expanding so that the ring 20 is secured on the grip 12. For example, the ring 20 could be formed of a material sufficiently resilient to allow placement of the ring over the upper end 14 of the grip 12, but then mechanically prevented from expanding once in place on the grip 12 by operation of the closure 30.

Another important aspect of the invention is to minimize the weight of the ring 20, so as not to adversely affect the balance of the club 10 and the golfer's swing. For this reason, the ring 20 preferably does not weigh over eight ounces (about 230 grams), such as less than four ounces (about 115 grams) and more preferably less than one ounce (about 30 grams) so as to be essentially imperceptible by the golfer. For example, one embodiment of the ring 20 weighed less than 0.5 ounce (less than about 14 grams).

Still another desirable feature of the invention is to prevent torsional slipping of the golfer's grip, i.e., rotation of the golfer's grip around the circumference of the grip 12. For this purpose, the ring 20 is preferably formed to have a recess or dimple 32 defined on its outer perimeter 26 and sized to accommodate a portion of the golfer's wrist or hand. The dimple 32 can be located anywhere on the outer perimeter 26, but is preferably located at the slot 28 as shown in FIG. 2. To minimize slipping of the user's wrist or hand from the dimple 32 and along the lower face 34 of the ring 20, an anti-slip region 36 is preferably present on the lower face 34. Suitable materials for the anti-slip region 36 include rubber or composite materials with relatively high coefficients of friction, e.g., higher than the remainder of the ring 20, or at least higher than the material that forms the inner perimeter 24 of the ring 20. In this manner, the ring 20 can be installed and removed from the grip 12 independent of the greater friction desired at the lower face 34 of the ring 20.

The ring 20 can be made by a variety of manufacturing methods such as molding, machining, casting, etc. Suitable dimensions for the outer and inner diameters and the axial thickness of the ring 20 (identified in FIG. 3 as "t") will vary, depending on the dimensions of the grip 12. In the previously-noted embodiment of the invention, the ring 20 had inner and outer diameters of about 0.875 inch and about 1.75 inches (about 22 mm and about 44 mm), respectively, with a thickness of about 0.375 inch (about 10 mm). The outer diameter of the ring 20 was found to be sufficiently large to prevent a golfer's hands from slipping off the grip 12.

While the invention has been described in terms of a preferred embodiment, it is apparent that other forms could be adopted by one skilled in the art. Therefore, the scope of the invention is to be limited only by the following claims.

The invention claimed is:

1. A device mountable on a golf club having a shaft with oppositely-disposed first and second ends, a grip at the first end of the shaft, and a head at the second end of the shaft, the grip having a first grip portion and a second grip portion located closer to the second end of the shaft than the first grip portion, the grip being tapered so that the second grip portion has a smaller diameter than the first grip portion, the device comprising:

a toroid-shaped body having an axis and a substantially uniform thickness in an axial direction of the body;

an opening in the body, coinciding with the axis of the body, and defining an inner perimeter of the body concentric with the axis of the body, the opening having a minimum dimension larger than the diameter of the second grip portion of the grip but smaller than the diameter of the first grip portion of the grip so that the body is prevented from being removed from the club over the first grip portion;

an outer perimeter spaced radially outward from and surrounding the inner perimeter and concentric with the axis of the body, the outer perimeter having a recess defined therein that is sized and contoured to accommodate a portion of a hand gripping the second grip portion of the grip, aside from the recess the outer perimeter being substantially uniformly spaced radially outward from the inner perimeter; and a slot in the body and extending between the inner and outer perimeters thereof, the slot having a maximum width greater than the diameter of the shaft to permit installation of the body on the golf club;

wherein the device weighs less than one ounce so as not to detrimentally affect swinging of the golf club.

2. The device according to claim 1, wherein the body is sufficiently rigid to resist distortion of the body when forced into an interference fit with the first grip portion of the body, and the slot is sized so that the device can only be installed on the club by passing the shaft of the club through the slot.

3. The device according to claim 1, wherein the body is sufficiently pliable to enable the device to be installed on the club by passing the first grip portion through the opening in the body, the device further comprising means for selectively causing the opening to acquire the minimum dimension thereof and thereby prevent removal of the device over the first grip portion.

4. The device according to claim 1, further comprising means on the body for resisting torsional slip of the hand grasping the grip and contacting the body while swinging the club.

5. The device according to claim 4, wherein the slip-resisting means comprises the recess defined on the outer perimeter and sized and contoured to accommodate a portion of the hand.

6. The device according to claim 4, wherein the slip-resisting means comprises a material on the body, the material defining a surface of the body disposed at an axial extremity thereof, the material having a higher coefficient of friction than a remaining portion of the body.

7. A device mounted on a golf club having a shaft with oppositely-disposed first and second ends, a grip at the first end of the shaft, and a head at the second end of the shaft, the grip having a first grip portion and a second grip portion located closer to the second end of the shaft than the first grip portion, the grip being tapered so that the second grip portion has a smaller diameter than the first grip portion, the device comprising:

a body having an axis of symmetry;

an opening in the body and coinciding with the axis of the body, the opening defining an inner perimeter of the body surrounding and concentric with the axis of the body and contacting the grip of the club, the opening having a minimum dimension larger than the diameter of the second grip portion of the grip but smaller than the diameter of the first grip portion of the grip so that the body is prevented from being removed from the club over the first grip portion;

an outer perimeter spaced radially outward from and surrounding the inner perimeter and concentric with the axis of the body, the outer perimeter having a recess defined therein that is sized and contoured to accommodate a portion of a hand gripping the second grip portion of the grip, aside from the recess the outer perimeter being substantially uniformly spaced radially outward from the inner perimeter; and a slot in the body and extending between the inner and outer perimeters thereof, the slot having a width greater than the diameter of the shaft to permit installation of the body on the golf club.

8. The device according to claim 7, wherein the body is sufficiently rigid and the slot is sized so that the device can only be installed on the club by passing the shaft of the club through the slot.

9. The device according to claim 7, further comprising means on the body for resisting torsional slip of the hand on the grip when swinging the club.

10. The device according to claim 9, wherein the slip-resisting means comprises the recess defined on the outer perimeter and sized and contoured to accommodate a portion of the hand.

11. The device according to claim 9, wherein the slip-resisting means comprises a material on the body, the material defining a surface of the body disposed at an axial extremity thereof, the material having a higher coefficient of friction than the body.

12. The device according to claim 7, wherein the device weighs less than 0.5 ounce so as not to detrimentally affect swinging of the golf club.

13. The device according to claim 7, wherein the body is sufficiently rigid to resist distortion of the body when forced into an interference fit with the first grip portion of the body.

14. The device according to claim 7, further comprising means for closing the slot in the body to prevent the device from being removed from the club.

15. A method for inhibiting hands of a golfer from slipping on a grip of a golf club having a shaft with oppositely-disposed first and second ends and a head at the second end of the shaft, the grip being at the first end of the shaft and having a first grip portion and a second grip portion located closer to the second end of the shaft than the first grip portion, the grip being tapered so that the second grip portion has a smaller diameter than the first grip portion, the method comprising the steps of:

providing a device having a body, an opening in the body so as to define an inner perimeter of the body, and an outer perimeter spaced radially outward from and surrounding the inner perimeter;

installing the device on the club;

securing the device on the club by pushing the device over the grip until an interference fit exists between the inner perimeter of the body and the first grip portion of the grip, wherein the opening in the body is sufficiently small to prevent the device from being removed from the club over the first grip portion; and then grasping the grip of the golf club with the hands of the golfer so that the device is a physical barrier between the hands on the grip and the first end of the shaft to reduce the risk of the hands slipping off the grip and off the first end of the shaft the golf club, wherein the grip of the golf club is grasped with the hands so that portions of at least one of the hands and wrists associated therewith are accommodated in a recess defined on the outer perimeter of the device to resist torsional slip of the hands gripping the grip when swinging the club.

16. The method according to claim 15, further comprising a slot in the body and extending between the inner and outer perimeters thereof, wherein the slot is sized so that the device can only be installed on the club by passing the shaft of the club through the slot.

17. The method according to claim 15, wherein the body is sufficiently rigid so as to resist distortion of the body during the step of securing the device on the grip.

18. The method according to claim 15, wherein the body is sufficiently pliable to enable the device to be installed on the club by passing the first grip portion through the opening in the body, the method further comprising the step of selectively causing the opening to acquire the minimum dimension thereof and thereby prevent removal of the device over the first grip portion.

* * * * *